United States Patent [19]

Salomon

[11] 4,063,751

[45] Dec. 20, 1977

[54] SKI BRAKE

[75] Inventor: Georges Pierre Joseph Salomon, Annecy, France

[73] Assignee: S.A. Ets Francois Salomon & Fils, Annecy, France

[21] Appl. No.: 670,007

[22] Filed: Mar. 24, 1976

[30] Foreign Application Priority Data

Mar. 28, 1975 France ..... 75.09988

[51] Int. Cl.[2] ..... A63C 7/10

[52] U.S. Cl. ..... 280/605

[58] Field of Search ..... 280/605, 604

[56] References Cited

U.S. PATENT DOCUMENTS 3,985,370 10/1976 Giorgetti et al. ..... 280/605

FOREIGN PATENT DOCUMENTS 2,408,941 9/1975 Germany ..... 280/605

*Primary Examiner*—Joseph F. Peters, Jr.
*Assistant Examiner*—Milton L. Smith
*Attorney, Agent, or Firm*—Haseltine, Lake & Waters

[57] ABSTRACT

A ski brake having at least one pivotal blade capable of being embedded into the snow and wherein the blade is urged to an inactive position by an elastic member of low tension. An elastic return member of a step-on pedal exerts a positive action on the blade only during raising of pedal to cause the blade to travel to its active position, while freeing the blade during the descent of the pedal in order to permit the low tension elastic member to return the blade to inactive position.

9 Claims, 12 Drawing Figures

SKI BRAKE

FIELD OF THE INVENTION

The present invention relates to a ski brake, that is to say apparatus adapted for preventing a ski from sliding on the slope when a safety binding is released at the time of a fall and the ski is no longer connected to the skier. Such a device replaces a safety strap as currently used.

BACKGROUND

This apparatus generally comprises at least one stop arm forming a blade pivotably mounted relative to the ski by means of a hinge. A pedal pivoted to the ski and connected to the blade through the intermediary of a connection mechanism extends above the upper surface of the ski and is acted on by an elastic member which tends to keep it raised. In this position, corresponding to the absence of a boot on the ski, the blade is in its active position for braking in which it projects below the underside of the ski. In this case, the blade penetrates, more or less, into the snow, preventing the ski from sliding down a slope so that the skier can easily recover it.

Ski brakes are known in which the pedal is connected to the blade by a rigid mechanism. When the skier puts his skis on, the pressure of his foot on the step-on pedal, and consequently on the ski, which must cause the brake to move to its inactive position, can involve penetration of the blade into the snow. The blade can then encounter an obstacle such as a stone or cake of ice, preventing it from raising to the inactive position. If the skier exerts force to mount the ski, he can break the brake. The ski can only be correctly mounted after having been moved on the snow, which is contradictory to the desired objective, namely automatic mounting onto the foot.

SUMMARY OF THE INVENTION

An object of the present invention is to overcome these disadvantages by providing a ski brake of particularly simple construction assuring the passage of the blade to its inactive position, after step-on, even if this blade is immobilized in the ground by an obstacle, simply by a slight raising of the ski by the foot of the user.

To this effect, this ski brake comprising at least one stop arm forming a blade pivotably mounted with respect to the ski between an inactive position and an active position in which this blade projects under the ski, a step-on pedal articulated to the ski above the upper surface thereof and connected to the blade through the intermediary of a connection mechanism and an elastic member for normally raising the step-on pedal and causing the blade to travel to active position is characterized in that the blade is permanently urged to the inactive position by an elastic member of low tension and in that the connection mechanism exerts a positive action on the blade only during the raising of the pedal to cause the blade to travel to active position, while freeing the blade during the descent of the pedal in order to permit the elastic member to return the blade to inactive position if no obstacle opposes it.

The ski brake in accordance with the invention presents the advantage that the energy supplied by the skier when he places his foot on the step-on pedal is not transmitted directly to the blade when this is blocked by an obstacle or sunk deeply into the ground. In fact, the descending travel of the pedal is freely effected considering that this pedal is not rigidly coupled to the blade. After the skier has mounted his boots on the skis, by raising his ski he frees the blade from the obstacle and the slightly stressed elastic member itself effects the return of the blade to its inactive position. As a result, the skier will have appreciable convenience and safety in use.

BRIEF DESCRIPTION OF THE DRAWING

Hereinafter will be described various embodiments of the present invention, by way of non-limitative example, with reference to the attached drawing wherein.

DETAILED DESCRIPTION

Figure 1:
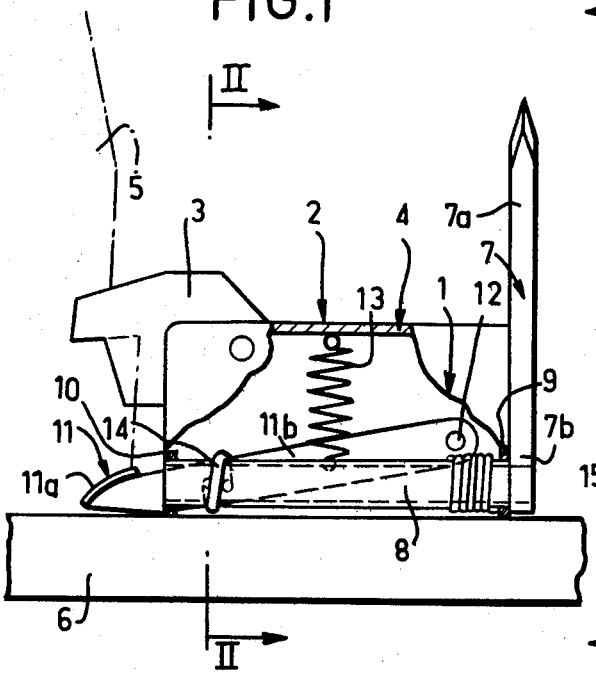
FIG. 1 is a side view partly broken away of a ski brake in accordance with the invention, in inactive position.

In the figures of the drawing, the same elements of the various embodiments of the ski brake in accordance with this invention are given the same reference numberals.

Referring to the first embodiment of the ski brake according to the invention, shown in FIGS. 1 to 4, we see that this brake denoted in entirety by numeral 1 is associated with a safety binding 2 represented solely by a movable jaw 3 and a body 4. In this case, the binding is a heelpiece holding the rear portion of a ski boot 5. The ski brake 1 and safety binding 2 are mounted on the upper surface of a ski 6. Naturally, in this embodiment of the ski brake, as in the other embodiments described later, this ski brake could be separated from the safety binding 2.

The ski brake 1 comprises a stop arm 7 forming a blade adapted to be embedded in the snow to stop the ski 6 when boot 5 is detached from the latter. The ski brake 1 can comprise a single blade 7 or two blades disposed symmetrically with respect to the longitudinal median plane of symmetry of the ski. The blade 7 comprises an upper arm 7*a* extending substantially vertically upwards in the inactive position shown in FIGS. 1 and 2, this upper arm being prolonged by a lower arm 7*b* bent relative thereto and fixed to a longitudinal shaft 8 rotating in longitudinally aligned bearings 9 and 10 provided in body 4 of the safety binding 2. The blade 7 is adjacent the rear transverse face of the body 4 but it could also be spaced therefrom.

Figure 2:
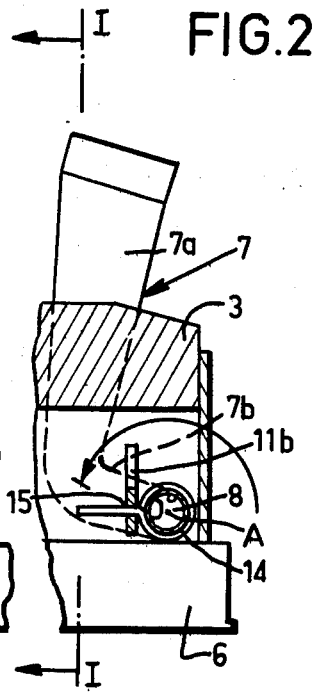
FIG. 2 is a partial cross-section taken along line II—II in FIG. 1.
Figure 3:
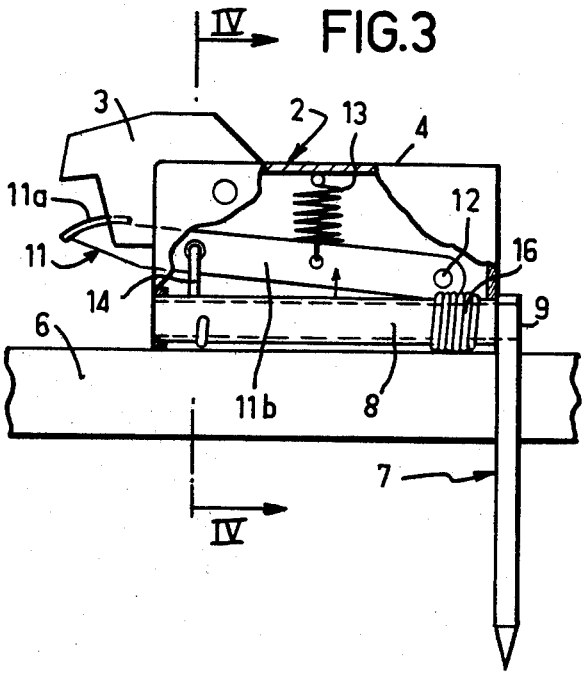
FIG. 3 is a view similar to that of FIG. 1, the brake being in active position.
Figure 4:
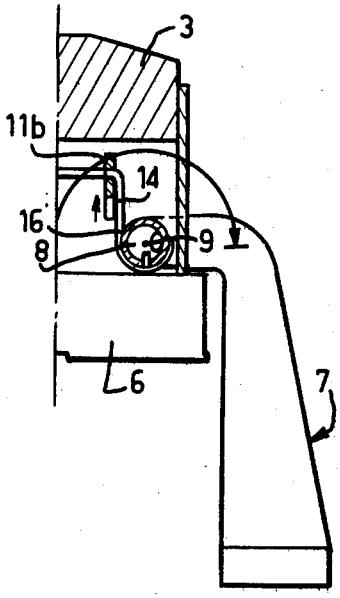
FIG. 4 is a transverse sectional view taken along line IV—IV on FIG. 3.
Figure 5:
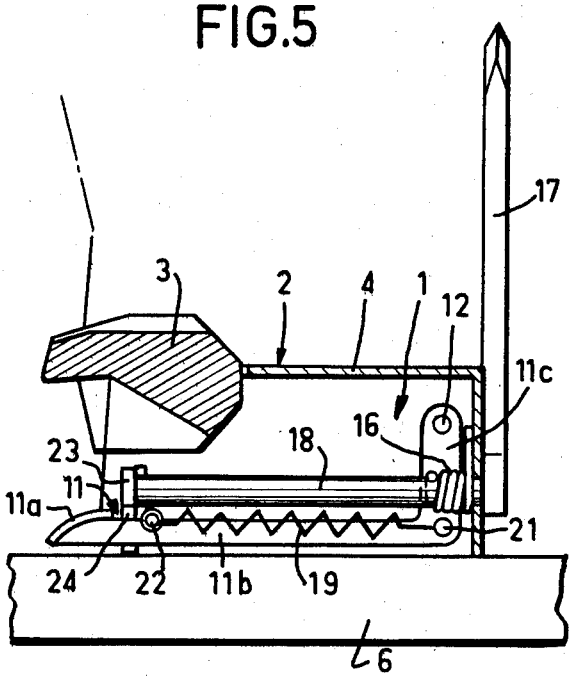
FIG. 5 is a longitudinal vertical section of one variant of the ski brake in inactive position.

The blade 7 can therefore pivot around a longitudinal axis A which is that of the shaft 8 between an inactive position shown in FIGS. 1 and 2 and an active position in FIGS. 3 and 4.

The mechanism controlling the travel of blade 7 between these positions comprises a step-on pedal 11 including a front transverse plate 11*a* which supports the heel of ski boot 5, this plate connecting two longitudinal lateral branches 11*b*, articulated at their rear ends, around a transverse shaft 12. The step-on pedal 11 thus forms a stirrup. This pedal is permanently urged towards its upper position (FIGS. 3 and 4), corresponding to the active position of the blade 7, by at least one highly stressed spring 13 connected at one end to the lateral branch 11*b* and at the other end to the body 4 of the safety binding. This spring can be a tension spring as shown in the drawing, or a compression spring acting in opposite direction or even a torsion spring centered on the transverse shaft 12, or any other spring (leaf spring, torsion bar, etc.).

The step-on pedal 1, which is located at the interior between the two shafts 8, is connected to each longitudinal shaft 8 by a transmission cable 14 one end of which is connected to shaft 8 and is wound thereon. This cable 14 is connected at its other end to the lateral branch 11*b* of the pedal 11. In the case where the ski brake comprises two symmetrical blades 7, the cable 14 is wound on the two opposite shafts 8 and passes through holes 15 formed in the two lateral branches 11*b*.

The winding direction of cable 14 on shaft 8 is such that when the pedal 11 moves from its lower position (FIGS. 1 and 2) to its upper position (FIGS. 3 and 4), the cable 14 is unwound causing shaft 8 to rotate clockwise, the result of which is to make blade 7 travel from its inactive position to its active position. This movement takes place when the boot 5 leaves the ski under the action of the highly stressed spring 13 which causes pedal 11 to pivot around the transverse shaft 12 clockwise in FIGS. 2 and 4.

To make the blade 7 travel from its active position to its inactive position at the time of mounting the boot on the ski, there is provided according to the invention, an auxiliary spring 16 of low tension which acts independently of the main spring 13 acting on pedal 11.

The auxiliary spring 16 is preferably constituted by a torsion spring wound on shaft 8, with one end bearing on the ski and the other end connected to shaft 8. The direction of winding of the auxiliary spring 16 on the shaft 8 is such that may be relatively stressed when blade 7 is in active position, and that its relaxation causes travel of this blade from the active position to the inactive position. The spring 16 is advantageously housed in the body 4 of the heelpiece, as can be seen in the drawing.

Thus, at the time of mounting the boot on the ski, when the boot 5 causes the pedal 11 to pivot downwardly against the action of spring 13, the cable 14 slackens and the auxiliary spring 16 can cause blade 7 to rotate counter clockwise in FIG. 4 to return it to its vertical inactive position as shown in FIG. 2, provided the blade is not blocked in the snow. In contrast, if the blade is blocked, the skier can unblock the blade merely by raising the attached ski, thus allowing spring 16 to return it to inactive position.

In the embodiment just described, the shaft 8 solid with the blade 7 is located immediately proximate the upper surface of the ski 6. This arrangement is made possible because the blade 7 has a shape bent substantially at 90° and can therefore extend vertically in active position as shown in FIG. 4.

It must be noted that the travel of the blades from the inactive position to the active position is produced by raising the pedal under the action of spring 13 whose action is therefore opposed so that of the spring 16. When it is said that spring 13 has a high tension while the spring 16 only has a low tension this only signifies that the former can counteract the action of the latter. This result can be obtained not only by the use of a strong spring and a weak spring but also by adjusting the length of the lever arms or the angle of application of the force of the springs, which could then be similar to each other.

In the variant shown in FIGS. 5 to 8, the blade 17 is substantially rectilinear and in active position (FIGS. 7 and 8) it is inclined outwardly and downwardly. As in the previous case, the blade 17 is solid with a longitudinal shaft 18 which, however, is located at a certain distance above the upper surface of the ski, to permit the pivotal movement of the blade 17. As before, this blade 17 is returned from its active position to its inactive position by a torsion spring 16 one end of which is connected to shaft 18 and the other end is, in this embodiment, fixed to body 4 of the safety binding.

In this embodiment, the step-on pedal 11 presents lateral branches 11*b* ending in arms 11*c* which extend upwardly. These arms 11*c* are articulated on the transverse shaft 12.

Pedal 11 is always urged in the clockwise direction by a main tension spring 19 connected at one end to a lug 21 located at the vertex formed by arm 11*c* and the lateral branch 11*b* and at the other end to a stud 22 carried at the front portion of the body 4. The main spring 19 is highly stressed and tends to make the step-on pedal 11 rotate to its raised position shown in FIG. 7.

The pedal 11 acts on blade 17 to cause it to travel from its inactive position to its active position, through the intermediary of a transverse arm 23 solid with the forward extremity of the shaft 18 and presenting on its inside edge, that is to say, facing the median longitudinal plane of the ski, a ramp 24. This ramp has a suitably curved form and it is always placed on the lateral branch 11*b* of the pedal 11, under the action of auxiliary spring 16 which causes the blades to return to their upward position.

Figure 6:
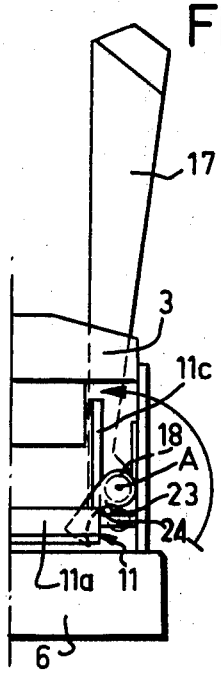
FIG. 6 is a partial front view of the brake in FIG. 5.
Figure 7:
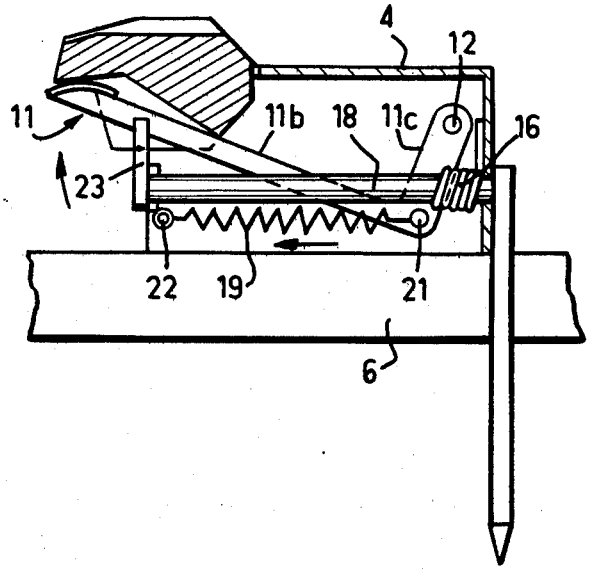
FIG. 7 is a longitudinal vertical section of the ski brake of FIG. 5, in the active position.
Figure 8:
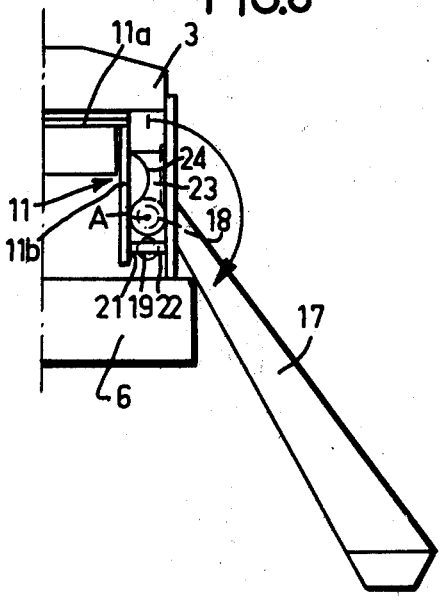
FIG. 8 is a partial front view of the brake in FIG. 7.
Figure 9:
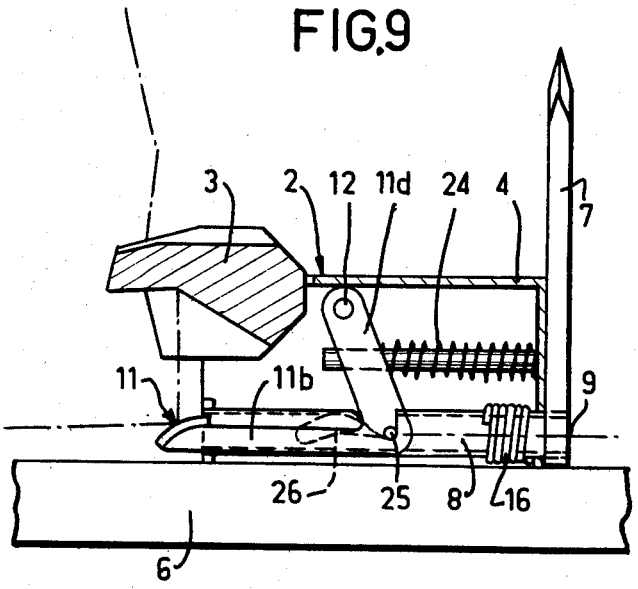
FIG. 9 is a longitudinal vertical section of another variant of the ski brake according to the invention, in inactive position.
Figure 10:
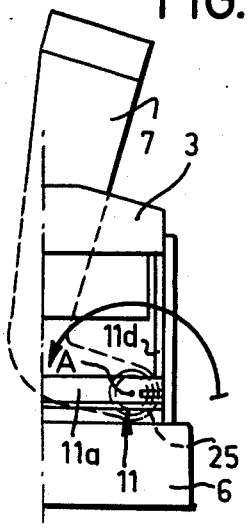
FIG. 10 is a partial front view of the brake in FIG. 9.
Figure 11:
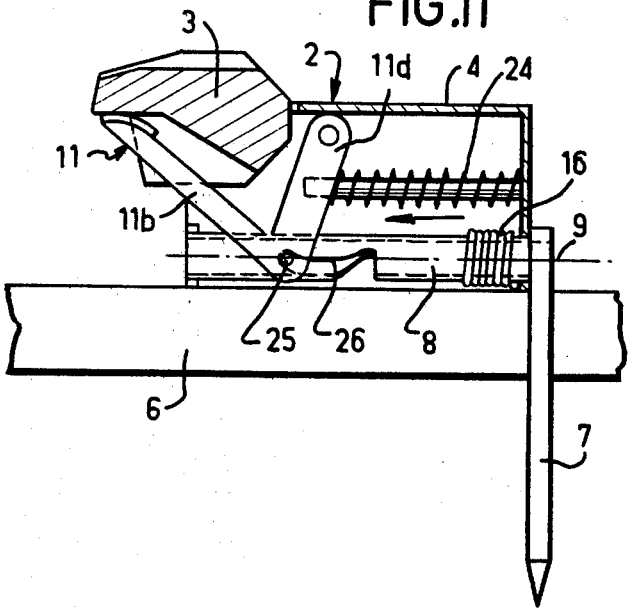
FIG. 11 is a longitudinal vertical section of the ski brake of FIG. 9 in active position.

In inactive position of the blade (FIGS. 5 and 6), the arm 23 is found inclined inwardly and downwardly and the ramp 24 is located above the upper edge of the lateral branch. When the pedal 11 is freed following disengagement of the binding, the pedal 11 and the branch 11*b* are raised, thus causing a pivoting of the arm 23 and of the blade 17 clockwise in FIGS. 6 and 8 to cause the blade to travel to active position. In this position, the arm 23 extends vertically upwards, being supported by the vertical face of the adjacent lateral branch 11*b*. At the time of remounting of the boot, when the pedal 11 is depressed and pivots counterclockwise in FIGS. 5 and 7, the arm 23 is released and due to the action of the auxiliary torsion spring 16, it can pivot counterclockwise with the longitudinal shaft 18 and blade 17 until the blade reaches its inactive postion as shown in FIG. 6.

In the variant shown in FIGS. 9 through 12, the blade 7 is designed and mounted in the manner illustrated in FIGS. 1 to 4. In this case, the step-on pedal presents, in elevation a V shape because the lateral branch 11a is integral with an arm 11*d* articulated around the transverse shaft 12 which arm is inclined upwardly and forwardly in the inactive position in FIG. 9. Against this arm bears a longitudinal compression spring 24, lying between this arm and the rear transverse face of body 4 of the binding. Because of this, the spring 24 urges the pedal 11 upwardly by pushing the arm 11*d* forwardly, the effect of which is to tend to cause this pedal to pivot clockwise around the transverse shaft 12.

Figure 12:
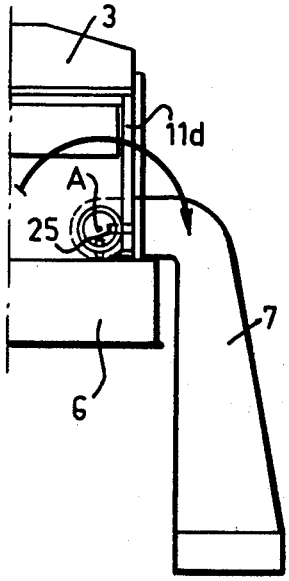
FIG. 12 is a partial front view of the brake in FIG. 11.

In this embodiment of the invention, the step-on pedal 11, which includes the two shafts 8 between its lateral branches 11b, acts on blade 7 by means of a lug 25 located at the vertex formed by lateral branch 11*a* and arm 11*d* and extending inwardly. This lug lies against a curved surface forming a cam 26 machined in shaft 8. The contour of this cam is such that when pedal 11 is raised under the action of spring 24 upon release of the binding, the lug 25 causes, through its pivotal movement around the transverse shaft 12, a concomitant rotation of the shaft 8 around the longitudinal axis A allowing the blade 7 to travel from its inactive position (FIG. 10) to its active position (FIG. 12).

It is to be noted that lug 25 is not fitted in a groove but is simply placed with one side against the surface forming the cam 26. At the time of mounting the boot on the ski, when pressure is applied to pedal 11, the lug 25 tends to move away from the cam 26, but is nevertheless kept in contact therewith since the low tension auxiliary spring 16 always maintains the surface 26 in contact with the lug 25. As in the preceding embodiments, it is the spring 16 which causes the return of the blade 7 to its inactive position.

According to an alternative embodiment, the compression spring 24 acting on pedal 11 could also be eliminated and its function assumed by the spring 16. This latter would then work both in torsion to act on shaft 8 and in compression on pedal 11. It would then suffice to mount the front bent end of spring 16, which is attached to shaft 8, for sliding movement in a longitudinal slot in order for the spring 16 to work in compression.

The embodiments which have just been described have, of course, been given solely by way of example and they are in no way limitative, and various alternatives could be conceived without departing from the spirit of the present invention. Thus, notably in all the described embodiments, the blade 7 or 17 has been shown as being pivotably mounted around a longitudinal shaft 8. However, the invention is also applicable to blades 7 articulated around a transverse axle, or inclined relative to the plane of the ski, the action of the auxiliary return spring 16 being exerted in the same manner in this last case.

What is claim is:

1. Ski brake apparatus adapted for being mounted on the upper surface of a ski, said apparatus comprising a step-on pedal pivotably mounted on the ski and having a raised inoperative position and a lowered operative position, elastic means acting on said step-on pedal urging said pedal to raised inoperative position, said pedal being lowered against the opposition of said elastic means by application of a boot on said pedal, a stop arm comprising a brake lever pivotably mounted on said ski for movement between a raised inactive position and a lowered active position, said blade projecting below the ski in said active position, connection means between said step-on pedal and said blade for urging said blade to active position when the step-on pedal is moved to its raised inoperative position by said elastic means and for being disconnected from said blade when the step-on pedal is lowered whereby said elastic means has no influence on said blade, and an elastic member of lower strength as compared to said elastic means connected to said blade to urge the blade to raised inactive position when the step-on pedal is lowered to operative position.

2. Ski brake apparatus as claimed in claim 1 wherein said elastic member is independent of said elastic means and is distinct therefrom.

3. Ski brake apparatus as claimed in claim 1 wherein said connection means comprises a cable connecting said pedal and said brake lever.

4. Ski brake apparatus as claimed in claim 3 wherein said connection means further comprises a rotatable shaft, said brake lever being fixed to said shaft for rotating therewith, said cable connecting said pedal and said shaft such that raising of said pedal produces rotation of said shaft and movement of said brake lever from said raised to said lowered position, whereas lowering of said pedal results in slackening of said cable whereby the brake lever can be raised by said elastic member.

5. Ski brake apparatus as claimed in claim 4 wherein said elastic member is a torsion spring wound on said shaft.

6. Ski brake apparatus as claimed in claim 1 wherein said connection means further comprises a rotatable shaft, said brake lever being fixed to said shaft for rotation therewith, a transverse arm secured to said shaft and having a ramp surface in contact with said pedal such that raising of the pedal produces rotation of said shaft and movement of said brake lever to active position, and lowering of said pedal frees the transverse arm and permits raising of said lever by said elastic member.

7. Ski brake apparatus as claimed in claim 6 wherein said elastic member is a torsion spring wound on said shaft.

8. Ski brake apparatus as claimed in claim 1 wherein said connection means further comprises a rotatable shaft, said brake lever being fixed to said shaft for rotation therewith, a lug secured to said pedal, said shaft having a cam surface engaged by said lug such that raising of said pedal produces rotation of said shaft and movement of said brake lever to active position and lowering of said pedal separates the lug from said cam surface to permit raising of the lever by said elastic member.

9. Ski brake apparatus as claimed in claim 8 wherein said elastic member is a torsion spring wound on said shaft.

* * * * *